US010081985B2

(12) United States Patent
Bullock

(10) Patent No.: US 10,081,985 B2
(45) Date of Patent: Sep. 25, 2018

(54) MONITORING A CONDITION OF A COMPONENT IN A ROTATING CONTROL DEVICE OF A DRILLING SYSTEM USING EMBEDDED SENSORS

(71) Applicant: Halliburton Energy Services, Inc., Houston, TX (US)

(72) Inventor: Raymond R. Bullock, Hoveton (GB)

(73) Assignee: Halliburton Energy Services, Inc., Houston, TX (US)

( * ) Notice: Subject to any disclaimer, the term of this patent is extended or adjusted under 35 U.S.C. 154(b) by 473 days.

(21) Appl. No.: 14/646,938

(22) PCT Filed: Dec. 31, 2012

(86) PCT No.: PCT/US2012/072268

§ 371 (c)(1),
(2) Date: May 22, 2015

(87) PCT Pub. No.: WO2014/105077

PCT Pub. Date: Jul. 3, 2014

(65) Prior Publication Data

US 2015/0337599 A1 Nov. 26, 2015

(51) Int. Cl.

| | |
|---|---|
| ***E21B 7/00*** | (2006.01) |
| ***E21B 3/00*** | (2006.01) |
| ***E21B 44/00*** | (2006.01) |

(Continued)

(52) U.S. Cl.

CPC ..... *E21B 7/00* (2013.01); *E21B 3/00* (2013.01); *E21B 21/08* (2013.01); *E21B 33/085* (2013.01); *E21B 44/00* (2013.01); *E21B 44/005* (2013.01); *E21B 47/0006* (2013.01); *E21B 47/01* (2013.01); *E21B 47/024* (2013.01); *E21B 47/06* (2013.01); *E21B 47/065* (2013.01)

(58) Field of Classification Search

CPC ..... E21B 21/08; E21B 33/085; E21B 3/00; E21B 44/00; E21B 44/005; E21B 47/0006; E21B 47/01; E21B 47/024; E21B 47/06; E21B 47/065; E21B 7/00

See application file for complete search history.

(56) References Cited

U.S. PATENT DOCUMENTS

| | | | |
|---|---|---|---|
| 5,679,894 | A | 10/1997 | Kruger et al. |
| 7,631,697 | B2 | 12/2009 | Bhavsar |

(Continued)

FOREIGN PATENT DOCUMENTS

| | | | |
|---|---|---|---|
| EP | 2050924 | 4/2009 | ..... E21B 33/08 |
| EP | 2489828 | 8/2012 | ..... E21B 47/00 |
| WO | 2011/162939 | 12/2011 | ..... G01V 11/00 |

OTHER PUBLICATIONS

Extended European Search Report received for European Application No. 12890950.4, dated Jun. 9, 2016; 8 pages.

(Continued)

*Primary Examiner* — Caroline N Butcher
(74) *Attorney, Agent, or Firm* — Baker Botts L.L.P.

(57) ABSTRACT

In accordance with some embodiments, a drilling system comprises a drill string and a rotating control device (RCD) associated with the drill string. The RCD includes a seal element composed of an elastomeric material. A sensor is embedded in the seal element and detects a drilling condition associated with the RCD during a drilling operation. A control system determines wear of the seal element based on the drilling condition.

28 Claims, 3 Drawing Sheets

(51) Int. Cl.

| | |
|---|---|
| ***E21B 47/06*** | (2012.01) |
| ***E21B 47/024*** | (2006.01) |
| ***E21B 47/00*** | (2012.01) |
| ***E21B 33/08*** | (2006.01) |
| ***E21B 21/08*** | (2006.01) |
| ***E21B 47/01*** | (2012.01) |

(56) References Cited

U.S. PATENT DOCUMENTS

| | | | |
|---|---|---|---|
| 8,162,050 | B2 | 4/2012 | Roddy et al. |
| 2005/0199401 | A1 | 9/2005 | Patel et al. |
| 2008/0236271 | A1 | 10/2008 | Zhang et al. |
| 2009/0236144 | A1 | 9/2009 | Todd et al. |
| 2009/0315267 | A1 | 12/2009 | Castleman |
| 2010/0008190 | A1 | 1/2010 | Gray et al. |
| 2010/0200213 | A1 | 8/2010 | Hughes et al. |
| 2011/0024195 | A1 | 2/2011 | Hover et al. |
| 2011/0036560 | A1 | 2/2011 | Vail, III et al. |

OTHER PUBLICATIONS

International Search Report and Written Opinion, Application No. PCT/US2012/072268, 12 pages, dated May 5, 2013.

Schlumberger Ltd.; HOLD Rotating Control Devices; available at http://www.slb.com/services/drilling/mpd_ubd/at_balance/rotating_control_devices/high_pressure_reds/hold_red.aspx, Nov. 13, 2012.

International Preliminary Report on Patentability, Application No. PCT/US2012/072268; 10 pages, dated Jun. 30, 2015.

Australian Office Action, Application No. 2012397805; 3 pages, dated Jan. 6, 2016.

Canadian Office Action, Application No. 2893128; 4 pages, dated May 12, 2016.

MONITORING A CONDITION OF A COMPONENT IN A ROTATING CONTROL DEVICE OF A DRILLING SYSTEM USING EMBEDDED SENSORS

RELATED APPLICATION

This application is a U.S. National Stage Application of International Application No. PCT/US2012/072268 filed Dec. 31, 2012, which designates the United States, and which is incorporated herein by reference in its entirety.

TECHNICAL FIELD

The present disclosure relates generally to equipment used and operations performed in connection with well drilling operations and, more particularly, to monitoring a condition of a component in a rotating control device of a drilling system using embedded sensors.

BACKGROUND

When performing closed annulus drilling operations, typically referred to as managed pressure drilling, underbalanced drilling, mud cap drilling, air drilling and mist drilling, a rotating control device (RCD), also referred to as a rotating drilling device, rotating drilling head, rotating flow diverter, pressure control device and rotating annular, may be used to divert drilling fluids returning from the well into chokes, separators and other equipment. The RCD may function to close off the annulus around a drill string during drilling operations. The sealing mechanism of the RCD, typically referred to as a seal element or packer, is operable to maintain a dynamic seal on the annulus, enabling chokes to control pressure of the annulus at the surface drilling operations. The seal element further allows drilling to continue while controlling influx of formation fluids.

The seal element may be made of a molded elastomeric packing material that includes different elastomeric compounds selected for different drilling applications. In some applications, the seal element rotates with the drill pipe and, in other applications, the seal element remains stationary while the drill pipe rotates within. As may be appreciated, the condition of the seal element is important to the operation and ongoing integrity of the RCD. However, the rotation and reciprocation of the drill pipe during drilling operations, often in conjunction with applied annulus pressure, may cause the seal element to wear such that the seal provided by the seal element degrades over time.

Conventional methods of monitoring wear in a seal element may involve physical testing of the seal element in a lab environment to determine the amount of degradation of the seal element based on the number of drill pipe tool joint passes and drill pipe rotational speed. The amount of degradation is then extrapolated to estimate how long the seal element can be used in the field, either based on a maximum amount of time, maximum drill pipe rotational speed or number of drill pipe tool joint passes. The wear and degradation, however, may be unpredictable using this method due to the varying surface conditions, and speed of reciprocation and rotation of the drill pipe. As a precautionary measure, the seal element may be changed prematurely leading to costly downtime of the drilling rig. An unexpected failure of the seal element may also lead to drill rig downtime and, in extreme cases, a release of annulus pressure that may result in the flow of drilling fluids into the surrounding environment.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Embodiments of the present disclosure and its advantages are best understood by referring to FIGS. 1 through 4, where like numbers are used to indicate like and corresponding parts.

Figure 1:
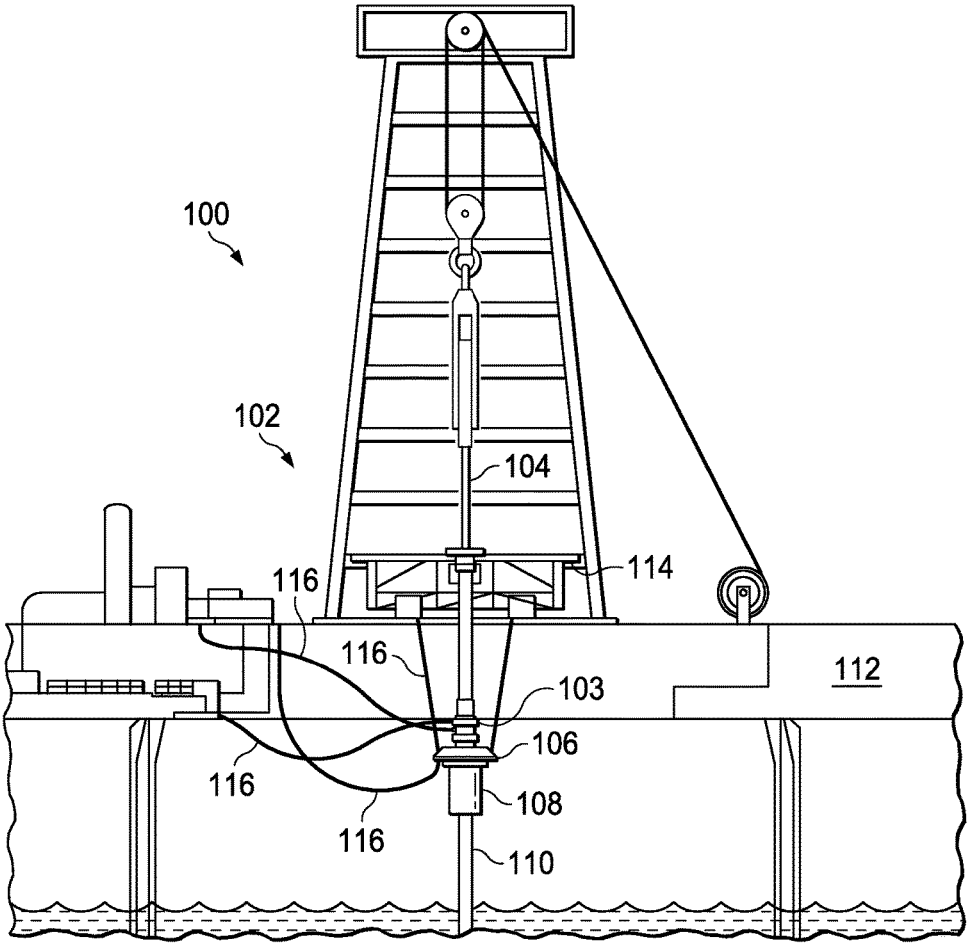
FIG. 1 illustrates an example embodiment of a drilling system configured to perform closed annulus drilling operations in accordance with some embodiments of the present disclosure.

FIG. 1 illustrates an example embodiment of a drilling system configured to perform closed annulus drilling operations, in accordance with some embodiments of the present disclosure. During closed annulus drilling operations, also referred to as managed pressure drilling, underbalanced drilling, mud cap drilling, air drilling and mist drilling, the annulus of the drill string is closed off using a device referred to as a rotating control device (RCD), a rotating drilling device, a rotating drilling head, a rotating flow diverter, pressure control device or a rotating annular. The principle sealing mechanism of the RCD, referred to as a seal element or packer, seals around the drill string, thus, closing the annulus around the drill string. During drilling operations, the seal element may experience wear that degrades the seal provided by the seal element. In order to minimize costly down time for the drilling system when replacing the seal element, sensors may be embedded in the seal element to monitor wear, degradation and vibration associated with the seal element.

As disclosed in further detail below and according to some embodiments of the present disclosure, the sensors may be embedded into the seal element during a molding process. In other embodiments, the sensors may be embedded into the seal element through drilled and sealed ports. The sensors may be nanosensors, optic fiber sensors and/or polymer fiber sensors that monitor for various drilling properties, including, but not limited to, strain, pressure, temperature, fluid level, position, material loss and vibration. By monitoring the condition of seal element in real time during drilling operations, use of the seal element may be optimized in the field. For example, where wear is low and the seal element wear is minimal, use of the seal element may be extended to save down time of the drilling system due to an unnecessary remedial replacement of the seal element. Where wear of the seal element is high and seal degradation is accelerated, the seal element may be replaced before a leak or loss of control event occurs. Accordingly, use of sensors embedded in the seal element according to the present disclosure may reduce down time of the drilling system and the cost associated with that down time.

Drilling system 100 may include drilling unit 102, drill string 104, rotating control device (RCD) 106, sliding joint 108 and riser assembly 110. Drilling unit 102 may be any type of drilling system configured to perform drilling operations. Although FIG. 1 illustrates the use of RCD 106 from a floating drilling unit, those skilled in the art will understand that RCD 106 can be deployed from any type of onshore or offshore drilling unit including, but not limited to, Semi Submersible, Drill Ship, Jack Up, Production Platform, Tension Leg Platform and Land Drilling units. In some embodiments, including, but not limited to, Land Drilling units and Jack Up drilling units, a surface blow out preventer (BOP) stack may be incorporated into the drilling system. In these embodiments, RCD 106 may be coupled to a drilling annular incorporated in the BOP stack, an operations annular added to the BOP stack and drilling annular, or directly coupled to the BOP stack. In other embodiments, RCD 106 may be coupled directly to a wellhead or casing head for drilling operations prior to the BOP stack being installed.

Drilling unit 102 may include rig floor 112 that is supported by several support structures (not expressly shown). Rotary table 114 may be located above rig floor 112 and may be coupled to drill string 104 in order to facilitate the drilling of a wellbore using a drill bit (not expressly shown) coupled to the opposite end of drill string 104. Drill string 104 may include several sections of drill pipe that communicate drilling fluid from drilling unit 102 and provide torque to the drill bit. In the illustrated embodiment, the drilling fluid may be circulated back to drilling unit 102 through riser assembly 110. In other embodiments, such as a land drilling unit, the drilling fluid may be circulated through the wellbore or a casing included in the wellbore. Additionally, various cables 116 may couple RCD 106, slip joint 108 and riser assembly 110 to equipment on drilling unit 102.

In the illustrated embodiment, drill string 104 may extend from drilling unit 102 through riser assembly 110 and into a subsea wellbore (not expressly shown) formed in the ocean floor. An upper portion of RCD 106 may be coupled to drilling unit 102 by an above RCD riser, tie back riser or telescoping joint, where the upper end of the riser or joint may be coupled to a drilling unit diverter housing (not expressly shown). A seal element or packer (not expressly shown) may be located within the body of RCD 106 and may be removed or inserted with the aid of latch assembly 103 integral, either internally or externally, to RCD 106. In some embodiments, latch assembly 103 may include a hydraulic clamp that can be remotely controlled from drilling unit 102, such as the clamp described in U.S. Patent Publication No. 2012/0125636, which is incorporated herein by reference. A lower portion of RCD 106 may be coupled to sliding joint 108. In one embodiment, sliding joint 108 may be a telescoping joint that includes an inner barrel and an outer barrel that move relative to each other in order to allow offshore platform 102 to move during drilling operations without breaking drill string 104 and/or riser assembly 110. In other embodiments, sliding joint 108 may be a multi-part sliding joint as described in U.S. Patent Publication No. 2008/0251257 to Leuchtenberg et al., which is incorporated herein by reference. Sliding joint 108 may be coupled to riser assembly 110, which provides a temporary extension of a subsea wellbore (not expressly shown) to offshore drilling unit 102.

Figure 2:
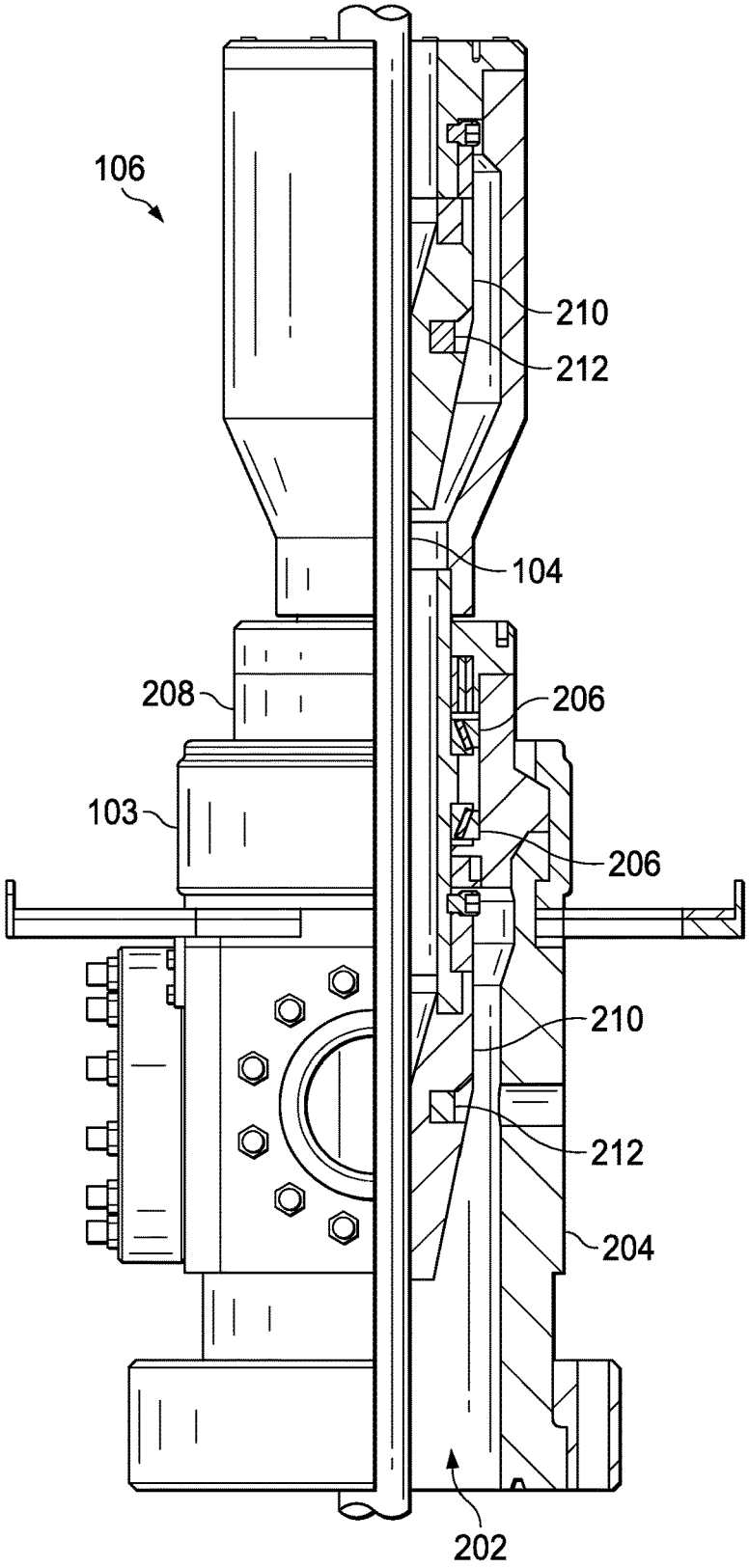
FIG. 2 illustrates a partial cross-sectional view of a rotating control device including sensors embedded in a seal element in accordance with some embodiments of the present disclosure.

FIG. 2 illustrates a partial cross-sectional view of RCD 106 including sensors embedded in a seal element in accordance with some embodiments of the present disclosure. RCD 106 may be used to seal annulus 202 formed radially between body 204 of RCD 106 and drill string 104 positioned within body 202. RCD 106 may allow drill string 104 to rotate and enter and exit the wellbore while maintaining pressure in annulus 202. In the illustrated embodiment, bearing assembly 206 may be located in bearing assembly housing 208. Seal element 210 may be coupled to body 204 of RCD 106 by a mandrel (not expressly shown) connected to bearing assembly 206 such that seal element 210 may rotate with drill string 104. In other embodiments, RCD 106 may not include bearing assembly 206 such that seal element 210 remains stationary while drill string 104 rotates within RCD 106. Latch assembly 103 may be used to secure and release bearing assembly 206 and seal element 210 relative to body 204.

Seal element 210 may form a seal around drill string 104 to close annulus 202 and maintain pressure in annulus 202 during drilling operations. In some embodiments, seal element 210 may be a molded device made of an elastomeric material. The elastomeric material may be compounds including, but not limited to, natural rubber, nitrile rubber, hydrogenated nitrile, urethane, polyurethane, fluorocarbon, perflurocarbon, propylene, neoprene, hydrin, etc. In one embodiment, sensors 212 may be embedded in seal element 210 during the molding process. In other embodiments, ports may be drilled into seal element 210 after the molding process is complete. Sensors 212 may be placed in the ports and the ports may be sealed to prevent drilling fluids from flowing into the ports.

During drilling operations, seal element 210 and the bearings (not expressly shown) of bearing assembly 206 may experience wear due to rotation and reciprocation of drill string 104. Sensors 212 embedded in seal element 210 may monitor various properties of seal element 210 and associated components of RCD 106 such that the rate and amount of degradation of seal element 210 and/or bearings in bearing assembly 206, and vibration associated with the bearings of bearing assembly 206 may be determined. For example, sensors 212 may monitor the wear and/or condition of seal element 210 by measuring drilling conditions, such as strain, pressure, temperature, fluid level, position, and material loss. Additionally, sensors 212 may determine whether the bearings in bearing assembly 206 are overloaded and/or worn by measuring the amount of vibration associated with bearing assembly 206 during drilling operations. The drilling operations may include but are not limited to, drilling ahead, reaming, back reaming, tripping drill pipe, stripping drill pipe, rotating drill pipe and sliding drill pipe. Sensors 212 may communicate the measured drilling conditions to a control system (such as the control system illustrated in FIG. 3) located on or remote from drilling unit 102 (as illustrated in FIG. 1). As described in more detail in reference to FIG. 3, the control system may correlate the drilling condition data to amount and/or rate of wear of seal element 210 and the bearings of bearing assembly 206 such that a drilling operator can make a determination of when to replace seal element 210 and/or the bearings of bearing assembly 206.

Sensors 212 may be any suitable type of device that is configured to detect drilling conditions during drilling operations. In one embodiment, sensors 212 may be nanosensors that have at least one feature with a dimension in the nanoscale range. For example, the feature of the device may be pore diameter, wire diameter, platelet length, particle mean diameter and the like. The substrate of sensors 212 may be any shape including, but not limited to, circular, elliptical, and polygonal. Possible compositions for the material used to form sensors 212 may include, but are not limited to, organic, inorganic, metallic, alloy, ceramic, conducting polymer, non-conducting polymer, ion conducting, non-metallic, ceramic-ceramic composite, ceramic-polymer composite, ceramic-metal composite, metal-polymer composite, polymer-polymer composite, metal-metal composite, metal salts, metal complexes, bio-organisms, biologically active materials, biologically derived materials, biocomposites, or a combination of one or more of these. In other embodiments, sensors 212 may be formed from optical or polymer fiber string.

Although FIG. 2 illustrates one sensor embedded in each of seal elements 210, any number of sensors may be embedded in each seal element 210. Additionally, sensors 212 may be strings embedded in seal element 210 in circumferential wraps or loops, vertical loops, single or multiple strings, lattice networks or any combination of sensing paths to achieve a desired range of sensing and monitoring.

Figure 3:
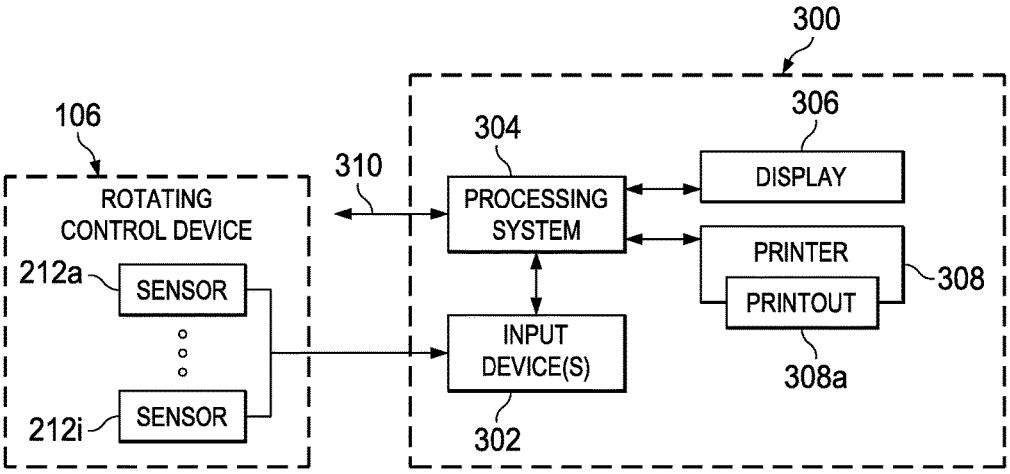
FIG. 3 illustrates a block diagram of a control system configured to receive measurements from the sensors embedded in the seal element of the rotating control device of FIG. 2 in accordance with some embodiments of the present disclosure.

FIG. 3 illustrates a block diagram of a control system configured to receive measurements from the sensors embedded in the seal element of the rotating control device of FIG. 2 in accordance with some embodiments of the present disclosure. In some embodiments, one or more sensors 212*a*-212*i* may be embedded in seal element 210 of RCD 106 in order to determine the wear and condition of seal element 210 during drilling operations.

Sensors 212 may be configured to measure any number of drilling conditions associated with determining wear and/or condition of seal element 210 during drilling operations including, but not limited to, strain, pressure, temperature, fluid level, position, material loss and vibration. Sensors 212 may measure these conditions using any suitable methods including, but not limited to, resistance, capacitance, inductance, impedance, phase angle, loss factor, dissipation, breakdown voltage, electrical temperature coefficient of an electrical property, Nernst current, impedance associated with ion conducting, open circuit potential, electrochemical property, electronic property, magnetic property, thermal property, mechanical property, or optical property.

Sensors 212 embedded in seal element 210 of RCD 106 may be communicatively coupled to input device 302 of control system 300 such that control system 300 may receive the drilling condition data and other information measured by sensors 212. Input device 302 may direct the data received from sensors 212 to data processing system 304. Processing system 304 may include a processor coupled to a memory. The processor may include, for example, a microprocessor, microcontroller, digital signal processor (DSP), application specific integrated circuit (ASIC), or any other digital or analog circuitry configured to interpret and/or execute program instructions and/or process data. In some embodiments, the processor may interpret and/or execute program instructions and/or process data stored in the memory. Such program instructions or process data may constitute portions of software for carrying out simulation, monitoring, or control of drilling operations. The memory may include any system, device, or apparatus configured to hold and/or house one or more memory modules; for example, the memory may include read-only memory, random access memory, solid state memory, or disk-based memory. Each memory module may include any system, device or apparatus configured to retain program instructions and/or data for a period of time (e.g., computer-readable non-transitory media). For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such as wires, optical fibers, and other electromagnetic and/or optical carriers; and/or any combination of the foregoing.

In some embodiments, control system 300 may be configured to receive drilling conditions detected by sensors 212 embedded in seal element 210 of RCD 106. Based on the drilling conditions, processing system 304 may determine the wear and/or condition of seal element 210. In one embodiment, pressure values at the lower end (e.g., the end towards the wellbore) of seal element 210 may be compared to pressure values at the upper end (e.g., the end towards drilling unit 102) of seal element 210. Rising pressures at the upper end in comparison to the lower end may be an indication of seal element wear, and may indicate that seal element 210 should be replaced. Similarly, the temperatures of various locations in seal element 210 may be measured. A change in temperature from the lower end to the upper end of seal element 210 may indicate that fluid has migrated from below seal element 210 to above seal element 210 and that seal element 210 is worn.

Other indications of wear may be made by monitoring seal element strain measurements. As each drill pipe tool joint passes through RCD 106, seal element 210 may be forced to expand and contract to conform to the tool joint outside diameter profile. As seal element 210 wears, reduced force (e.g., strain) may be needed to expand and contract seal element 210, thus, indicating material loss and wear in seal element 210. Similarly direct measurements of seal element mass and material loss may be an indication of wear. The measurements from sensors 212 may be correlated, for example, to the number of drill pipe tool joint passages, quantity of rotating hours, differential pressures across seal element 210 and other parameters to gauge the status of seal element 210 and estimate and/or predict the remaining life of seal element 210. The estimated life of seal element 210 may be compared to a maximum life for seal element 210 to determine whether seal element 210 needs to be replaced. By estimating the remaining life of seal element 210, costly and time consuming operations associated with drill rig downtime to replace seal element 210 may be avoided when seal element 210 has remaining life.

In other embodiments, the measured vibrations associated with RCD 106 may be used to monitor the condition and performance of the bearings in bearing assembly 206. Seal element 210 may be coupled to bearing assembly 206 using a mandrel (not expressly shown) such that seal element 210 and the mandrel rotate on bearings in bearing assembly 206 as a single unit. A measured vibration associated with the mandrel and seal element 210 that is equal to or greater than a pre-determined threshold may indicate that the condition and/or performance of the bearings in bearing assembly 206 may be degrading. As such, the drilling operator may adjust various drilling parameters including, but not limited to, the rotational speed of drill string 104, weight on bit and rate of penetration in order to optimize the life of the bearings in bearing assembly 206.

Processing system 304 may be communicatively coupled to display 306 that is part of control system 300 such that information processed by processing system 304 (e.g., strain, pressure, temperature, fluid level, position, material loss and vibration, etc.) may be conveyed to operators of a drilling system (e.g., drilling system 100 as illustrated in FIG. 1). Printer 308 and associated printouts 308*a* may also be used to report the wear of RCD 106. Outputs 310 may be communicated to various components associated with operating the associated drilling system, to various remote locations to monitor and/or control the performance of the drilling system, or to users simulating the drilling of a wellbore.

Modifications, additions, or omissions may be made to FIG. 3 without departing from the scope of the present disclosure. For example, the number of sensors 212 and the drilling conditions measured by sensors 212 may vary depending on the drilling application.

Figure 4:
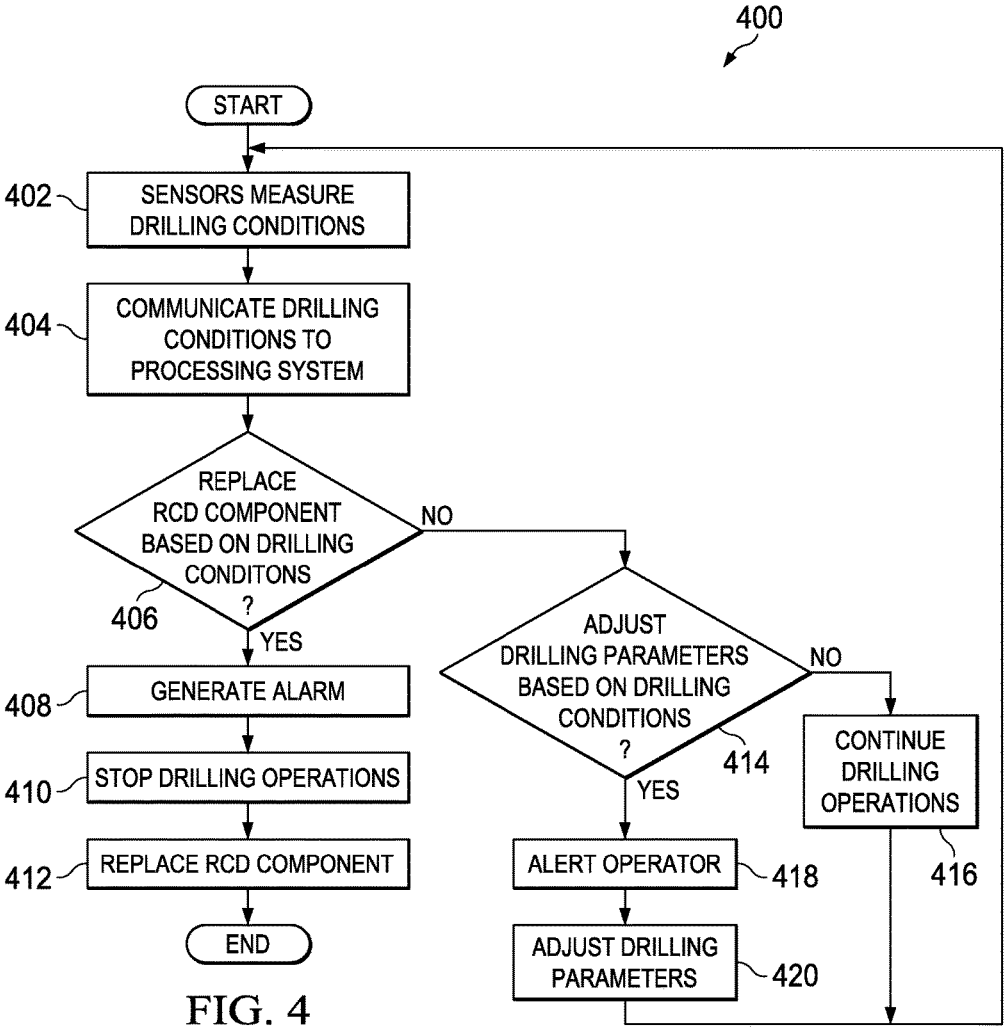
FIG. 4 illustrates a flow chart of an example method for monitoring a condition of a component in a rotating control device during drilling operations in accordance with some embodiments of the present disclosure.

FIG. 4 illustrates a flow chart of an example method for monitoring a condition of a component in a rotating control device during drilling operations in accordance with some embodiments of the present disclosure. The method is described as being performed by sensors 212 described with respect to FIG. 2 and processing system 304 described with respect to FIG. 3, however, any other suitable system, apparatus or device may be used. Generally, sensors 212 may be embedded in seal element 210 (as illustrated in FIG. 2) of RCD 106 for measuring various drilling conditions during drilling operations. The drilling conditions may include, but are not limited to, strain, pressure, temperature, fluid level, position, material loss and vibration. The measured values for the various drilling conditions may be used by processing system 304 in order to make a determination of the condition of seal element 210 and other associated components of RCD 106, including the condition of the bearings in bearing assembly 206. If processing system 304 determines that seal element 210 and/or the bearings in bearing assembly 206 are worn, drilling operations may be stopped so that seal element 210 and/or the bearings may be replaced. On the other hand, if processing system 304 determines that there is no wear or the wear is minimal, drilling operations may continue, thus, avoiding drill rig downtime if the seal element 210 and/or the bearings in bearing assembly 206 do not need to be replaced.

Method 400 may start, and at step 402, sensors 212 may measure one or more drilling conditions during drilling operations. The drilling conditions may include, but are not limited to, strain, pressure, temperature, fluid level, position, material loss and vibration. As described above, these drilling conditions may be used to determine a condition (e.g. amount of and/or rate of wear) associated with seal element 210 and/or the bearings in bearing assembly 206.

At step 404, sensors 212 may communicate the detected drilling conditions to processing system 304 that is configured to receive measurements from sensors 212 during drilling operations. In some embodiments, data representing the drilling conditions may be communicated from sensors 212 to input device 302 using transmitters/receivers in various locations of a drilling system (e.g., drilling system 100 as shown in FIG. 1). The locations may include, but are not limited to, (i) body 204, bearing assembly 206, tie back and upper stripper of RCD 106, (ii) the hydraulic power unit (HPU), (iii) the work platform, the control console and the rig floor of the drilling unit, such drilling unit 102 of FIG. 1, and (iv) near the wellhead. In other embodiments, the data from sensors 212 may be communicated through wires, such as electrical wires or fiber optics. In additional embodiments, communication of the drilling conditions from sensors 212 may be wireless. For example, the signals carrying the drilling conditions may be acoustic, electromagnetic or optical. The measurements may be communicated by sensors 212 either continuously or based on a pre-determined time interval.

At step 406, processing system 304 may determine whether seal element 210 and/or the bearings in bearing assembly 206 should be replaced based on one or more of the detected drilling conditions. In one embodiment, processing system 304 may compare the detected drilling conditions to a pre-determined threshold. If the detected drilling condition is above or below the pre-determined threshold, depending on the particular drilling condition, processing system 304 may determine that seal element 210 and/or the bearings in bearing assembly 206 should be replaced. The comparison to the pre-determined threshold may be based on a single measurement of the particular drilling condition or a change (either an increase or decrease) in the drilling condition over time. Additionally, processing system 304 may make a determination of whether seal element 210 and/or the bearings of bearing assembly 206 should be replaced based on one drilling condition or a combination of several drilling conditions. In other embodiments, the detected drilling conditions may be used to calculate the estimated life of seal element 210 and/or the bearings of bearing assembly 206 during the drilling operations. The estimated life of either component may be used to determine whether seal element 210 and/or the bearings of bearing assembly 206 should be replaced. For example, processing system 304 may determine that that seal element 210 and/or the bearings in bearing assembly 206 are wearing at an increased rate and should be replaced if the estimated life is less than the maximum lifetime determined under lab conditions. In contrast, an estimated life that is greater than the maximum lifetime may indicate that seal element 210 and/or the bearings in bearing assembly 206 are wearing at a decreased rate and that drilling operations can continue. By calculating the lifetime of the components, a failure in seal element 210 and/or bearing assembly 206 during drilling operations may be prevented and costly downtime due to prematurely replacing seal element 210 and/or the bearings in bearing assembly 206 when neither is worn may be avoided.

If processing system 304 determines that seal element 210 and/or the bearings in bearing assembly 206 should be replaced, processing system 304 may issue an alarm indicating that seal element 210 and/or the bearings in bearing assembly 206 are worn at step 408. The alarm may be an audible and/or visual signal to the operator of the drilling system and may be displayed on display 306. Upon receiving the alarm, the drilling operator may stop drilling operations at step 410 and seal element 210 and/or the bearings in bearing assembly 206 may be replaced at step 412.

If processing system 304 determines that seal element 210 and/or the bearings do not need to be replaced, processing system 304 may determine if any drilling parameters should be adjusted based on the drilling conditions at step 414. For example, processing system 304 may make the determination based on one or more drilling conditions being either above or below a pre-determined threshold at a given time or a change in the drilling conditions over time. Additionally, processing system 304 may calculate the estimated lifetime of seal element 210 and/or the bearings in bearing assembly 206 during drilling operations. If processing system 304 determines that seal element 210 and/or the bearings in bearing assembly 206 will reach their lifetime before drilling operations are complete, processing system 304 may determine adjustments to certain drilling parameters in order to extend the lifetime of seal element 210 or the bearings in bearing assembly 206. If processing system 304 determines that no drilling parameters should be adjusted, drilling operations may continue at step 416 and method 400 may return to step 402 to continue measuring the drilling conditions.

If processing system 304 determines that a drilling parameter should be adjusted, processing system 304 may communicate a suggested adjustment to the drilling operator via display 306 at step 418. In one embodiment, sensors 212 may provide a measurement of the vibration associated with RCD 106. The amount of vibration may be used to indicate or estimate the life of seal element 210 and/or the bearings in bearing assembly 206 at any given drilling conditions. If the vibration is above a pre-determined threshold, processing system 304 may generate an alarm and either suggest an adjustment to the drilling operator via display 306 and/or automatically adjust the parameter. For example, the rotation speed of drill string 104, the weight on bit, the rate of penetration, the stripping speed and/or the tripping speed may be adjusted in order to reduce vibrations and extend the life of the bearings in bearing assembly 206 and/or seal element 210. At step 410, the operator may make the adjustment and/or processing system 304 may automatically adjust the drilling parameters.

Modifications, additions, or omissions may be made to method 400 without departing from the scope of the present disclosure. For example, the order of the steps may be performed in a different manner than that described and some steps may be performed at the same time. Additionally, each individual step may include additional steps without departing from the scope of the present disclosure.

Although the present disclosure and its advantages have been described in detail, it should be understood that various changes, substitutions and alterations can be made herein without departing from the spirit and scope of the disclosure as defined by the following claims.

What is claimed is:

1. A drilling system, comprising:
- a drill string;
- a rotating control device (RCD) associated with the drill string, the RCD including a seal element composed of an elastomeric material;
- a sensor embedded in the seal element, the sensor configured to detect a drilling condition associated with the RCD during a drilling operation; and
- a control system configured to determine a rate of wear of the seal element by comparing the drilling condition to a pre-determined threshold.

2. The drilling system of claim 1, wherein the drilling condition is selected from the group consisting of strain, pressure, temperature, fluid level, position, material loss and vibration.

3. The drilling system of claim 1, wherein the sensor is selected from the group consisting of a nanosensor, an optic fiber and a polymer fiber.

4. The drilling system of claim 1, wherein the control system is further configured to:
- calculate an estimated lifetime of the seal element based on the drilling condition;
- compare the estimated lifetime with a maximum lifetime for the seal element; and
- determine that the seal element should be replaced if the estimated lifetime is less than the maximum lifetime.

5. The drilling system of claim 1, wherein the RCD further comprises:
- a bearing assembly including a plurality of bearings;
- a mandrel coupled to the bearing assembly; and
- the seal element coupled to the mandrel, the sensor further configured to determine wear of the bearings in the bearing assembly based on the detected drilling condition.

6. The drilling system of claim 5, wherein the control system is further configured to:
- determine the wear of the bearings in the bearing assembly by comparing the drilling condition to a pre-determined threshold; and
- determine an adjustment of a drilling parameter based on the wear of the bearings in the bearing assembly.

7. The drilling system of claim 5, wherein the control system is further configured to:
- calculate an estimated lifetime of the bearings in the bearing assembly based on the drilling condition;
- compare the estimated lifetime with a maximum lifetime for the bearings in the bearing assembly; and
- determine that the bearings in the bearing assembly should be replaced if the estimated lifetime is less than the maximum lifetime.

8. The drilling system of claim 1, wherein the control system is further configured to:
- compare a first pressure value detected at a wellbore end of the seal element to a second pressure value detected at a surface end of the seal element; and
- determine, based on the comparison, that the seal element should be replaced if the first pressure value is less than the second pressure value.

9. The drilling system of claim 1, wherein the control system is further configured to:
- compare a first temperature detected at a wellbore end of the seal element to a second temperature detected at a surface end of the seal element; and
- determine, based on the comparison, that the seal element should be replaced if the first temperature is less than the second temperature.

10. The drilling system of claim 1, wherein the control system is further configured to:
- measure a first strain at the seal element when a first tool joint passes through the seal element;
- measure a second strain at the seal element when a second tool joint passes through the seal element; and
- determine that the seal element should be replaced if the second strain is less than the first strain.

11. A rotating control device (RCD) configured to be used in a drilling system, comprising:
- a seal element composed of an elastomeric material; and
- a sensor embedded in the seal element, the sensor configured to:
  - detect a drilling condition associated with the RCD during a drilling operation; and
  - communicate the drilling condition to a control system configured to determine a rate of wear of the seal element by comparing the drilling condition to a pre-determined threshold.

12. The rotating control device of claim 11, wherein the drilling condition is selected from the group consisting of strain, pressure, temperature, fluid level, position, material loss and vibration.

13. The rotating control device of claim 11, wherein the sensor is selected from the group consisting of a nanosensor, an optic fiber and a polymer fiber.

14. The rotating control device of claim 11, further comprising: a bearing assembly including a plurality of bearings;

a mandrel coupled to the bearing assembly; and the seal element coupled to the mandrel, the sensor further configured to determine wear of the bearings in the bearing assembly based on the detected drilling condition.

15. The rotating control device of claim 11, wherein the sensor is further configured to continuously detect the drilling condition.

16. The rotating control device of claim 11, wherein the sensor is further configured to detect the drilling condition at a pre-determined interval.

17. A method of determining a condition of a component m a rotating control device for use in a drilling system, comprising:

receiving, at a control system, a drilling condition detected during a drilling operation by a sensor embedded in a seal element of a rotating control device (RCD); and determining a rate of wear of the seal element by comparing the drilling condition to a pre-determined threshold.

18. The method of claim 17, wherein the drilling condition is selected from the group consisting of strain, pressure, temperature, fluid level, position, material loss and vibration.

19. The method of claim 17, further comprising:

calculating an estimated lifetime of the seal element based on the drilling condition;

comparing the estimated lifetime with a maximum lifetime for the seal element; and determining that the seal element should be replaced if the estimated lifetime is less than the maximum lifetime.

20. The method of claim 17, wherein the RCD further comprises:

a bearing assembly including a plurality of bearings;

a mandrel coupled to the bearing assembly; and the seal element coupled to the mandrel, the sensor further configured to determine wear of the bearings in the bearing assembly based on the detected drilling condition.

21. The method of claim 20, further comprising:

comparing the drilling condition to a pre-determined threshold to determine the wear of the bearings in the bearing assembly; and determining an adjustment of a drilling parameter based on the wear of the bearings in the bearing assembly.

22. The method of claim 20, further comprising:

calculating an estimated lifetime of the bearings in the bearing assembly based on the drilling condition;

comparing the estimated lifetime with a maximum lifetime for the bearings in the bearing assembly; and determining that the bearings in the bearing assembly should be replaced if the estimated lifetime is less than the maximum lifetime.

23. A system of determining a condition of a component of a rotating control device for use in a drilling system, comprising:

a processor;

a computer readable memory communicatively coupled to the processor; and processing instructions encoded in the computer readable memory, the processing instructions, when executed by the processor, operable to perform operations comprising:

receiving, at a control system, a drilling condition detected during a drilling operation by a sensor embedded in a seal element of a rotating control device (RCD); and determining wear of the seal element by comparing the drilling condition to a pre-determined threshold.

24. The system of claim 23, wherein the drilling condition is selected from the group consisting of strain, pressure, temperature, fluid level, position, material loss and vibration.

25. The system of claim 23, wherein the processing instructions are further operable to perform operations comprising:

calculating an estimated lifetime of the seal element based on the drilling condition;

comparing the estimated lifetime with a maximum lifetime for the seal element; and determining that the seal element should be replaced if the estimated lifetime is less than the maximum lifetime.

26. The system of claim 23, wherein the RCD further comprises:

a bearing assembly including a plurality of bearings;

a mandrel coupled to the bearing assembly; and the seal element coupled to the mandrel, the sensor further configured to determine wear of the bearings in the bearing assembly based on the detected drilling condition.

27. The system of claim 26, wherein the processing instructions are further operable to perform operations comprising:

comparing the drilling condition to a pre-determined threshold to determine the wear of the bearings in the bearing assembly; and determining an adjustment of a drilling parameter based on the wear of the bearings in the bearing assembly.

28. The system of claim 26, wherein the processing instructions are further operable to perform operations comprising:

calculating an estimated lifetime of the bearings in the bearing assembly based on the drilling condition;

comparing the estimated lifetime with a maximum lifetime for the bearings in the bearing assembly; and determining that the bearings in the bearing assembly should be replaced if the estimated lifetime is less than the maximum lifetime.

* * * * *